US005784856A

United States Patent [19]

Altvater et al.

[11] Patent Number: 5,784,856

[45] Date of Patent: Jul. 28, 1998

[54] ROUND BALE PRESS FOR REFUSE AND REFUSE PACKING DEVICES WITH SUCH A ROUND BALE PRESS

[75] Inventors: Jakob Altvater, Bad Wurzach; Erwin Rampp, Wolfertschwenden; Erich Sieger, Friedrichshafen, all of Germany

[73] Assignee: Altvater RPP 1200 GmbH, Germany

[21] Appl. No.: 611,425

[22] Filed: Mar. 6, 1996

[30] Foreign Application Priority Data

Oct. 2, 1995 [DE] Germany ..... 195 36 750.2

[51] Int. Cl.[6] ..... B65B 63/04

[52] U.S. Cl. ..... 53/118; 53/587

[58] Field of Search ..... 53/118, 587; 56/341, 56/343; 100/5, 88, 89

[56] References Cited

U.S. PATENT DOCUMENTS

| | | | |
|---|---|---|---|
| 4,296,595 | 10/1981 | Meiners | 53/118 X |
| 4,514,969 | 5/1985 | Moosbrucker et al. | 53/587 X |
| 4,532,758 | 8/1985 | Liet | 56/341 |
| 4,841,851 | 6/1989 | Quataert | 53/587 X |
| 5,224,328 | 7/1993 | Viaud . | |
| 5,255,501 | 10/1993 | McWilliams | 100/88 X |

FOREIGN PATENT DOCUMENTS

| | | | |
|---|---|---|---|
| 551228 | 7/1993 | European Pat. Off. | 53/587 |
| 3415310 | 10/1985 | Germany . | |
| 3941727 | 6/1991 | Germany . | |
| WO 95/00324 | 1/1995 | WIPO . | |

*Primary Examiner*—Linda Johnson

*Attorney, Agent, or Firm*—Finnegan, Henderson, Farabow, Garrett & Dunner, L.L.P.

[57] ABSTRACT

A round bale press for refuse, in particular for domestic refuse, bio-waste, sewage slurry, having a plurality of spaced rolls (1), at least one of which is capable of being driven, at least one endless belt (2) supported by the rolls (1), and a cylindrical pressing chamber (3) with a feed opening (4) on the peripheral side. The pressing chamber is capable of being formed by movement of the rolls (1) along a predetermined path line and by end walls (11) arranged at the end faces of the rolls (1). Additionally, the round bale press is included in a refuse packaging apparatus having a wrapping apparatus (40) downstream from the press for wrapping the pressed refuse bale, wrapped on the peripheral side in a netting web, in one or more foil webs (41), and a delivery station (50) beyond the wrapping apparatus (40) for the refuse bales completely wrapped in the foil web (41).

28 Claims, 6 Drawing Sheets

Figure 1:
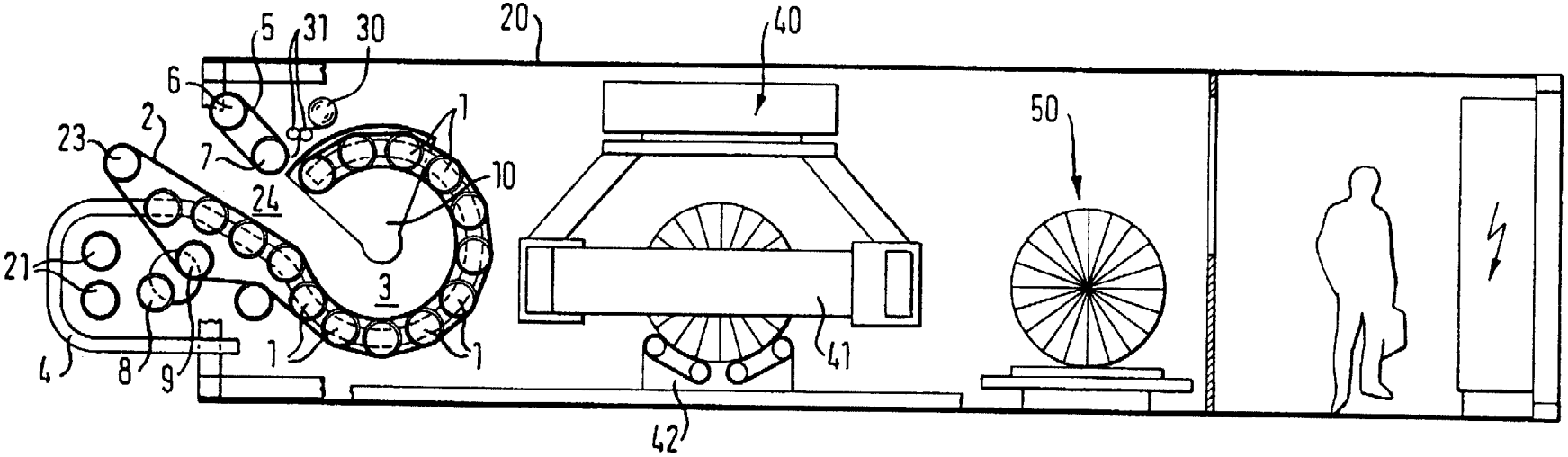

ROUND BALE PRESS FOR REFUSE AND REFUSE PACKING DEVICES WITH SUCH A ROUND BALE PRESS

The invention relates to a round bale press for refuse, in particular domestic refuse, bio-refuse, sewage slurry, old paper, old cloths, plastics, untreated compost or mixtures of these materials, and to a refuse packaging device with such a round bale press.

The transport, storage and disposal of refuse, in particular domestic refuse, bio-refuse, sewage slurry or other waste materials can be optimized in terms of space, time and quantity by pressing into cylindrical or cylindrical section refuse bales and complete wrapping thereof into a foil.

During the rolling process in the round bale production, the hollow spaces and the quantity of entrained air are reduced. In contrast to this, in a quadratic bale pressing technique, the entrained air is only compressed, i.e. the oxygen content is not reduced. As a result of the additional, complete wrapping in an air-tight and water-tight foil, the residual quantity of air trapped in the round bales releases the oxygen to the carbon atoms so that $CO_2$ is produced. This phase effects the complete consumption of the oxygen in the covered refuse bales. The chemical process of $CO_2$-formation causes a temperature in the bale interior approximately 10° C. higher than the ambient temperature. On account of the temperature in the bale interior, the residual moisture of the bale contents is deposited on the foil skin. The moisture diffuses on account of the temperature gradient from the bale interior to the bale exterior through the foil so that the bale contents is completely dried out. This has the effect that no foul gases such as methane can be produced in the bale interior.

In the case of subsequent wrapping up of the refuse bales in an air-tight and water-tight foil, the refuse can be optimally stored without odour pollution, for example in a waste incentery plant. Additionally, transfer stations can be set up which increase efficiency of use of waste collecting vehicles. The densifying of the filling material also considerably reduces the transport costs. Refuse odour and germ sources are trapped in refuse bales treated in this way. A scattering of paper and packaging is eliminated. Ground water pollution can be excluded, which makes intermediate storage of the refuse possible on any surface. Difficult and expensive intermediate storage surfaces with ground water protection layers etc. are no longer necessary.

A device for packing refuse is known from DE 39 41 727 A1 in which the main component of the unit consists of a round bale press known from agricultural technology and has a net binding device by means of which a refuse bale formed in the press is wrapped and fixed in shape before discharge from the press. The final wrapping on all sides of the refuse bale fixed in shape in this manner then takes place in a wrap-around device downstream of the press, the device consisting essentially of a rotating table and two rolls arranged on this rotating table which carry the bale. A web needed to wrap the finished bale is then drawn from a fixed holder for a foil web roll associated with the device. The round bale press used in this known device for producing the refuse bale consists of parallel spaced rolls which are arranged in circular form. The refuse is introduced through a peripheral filling opening into a pressing chamber formed by the rolls and is pressed into a cylindrical refuse bale by the rolls when they are rotated. The refuse bales are then covered on their periphery by a netting web and fixed in shape. After swinging away some of the rolls upwardly, the refuse bale is transferred to a storage path and transported onto a wrapping table. The refuse bale fixed in shape by the netting web is rotated about its cylindrical axis and simultaneously about its vertical axis on the wrapping table. In this manner, a complete foil wrap is produced on the end faces and the peripheral surface. The known round bale press is disadvantageous in that trickling substances can fall out of the press. Additionally, the packaging of very damp refuse such as sewage slurry is not possible in this known round bale press.

A press device for waste is known from WO 95/9500324 in which a semicircular pressing part includes a drivable endless belt and two opposing disks rotatable into the hemispherical form of the pressing part such that a cylindrical pressing chamber is formed. The belt has engaging means on the respective edges which engage in corresponding lugs on the disks. By rotation of the disks, the endless belt is driven. A sealable pressing chamber cannot be produced with such an apparatus for pressing refuse bales. Refuse can be blown out under the influence of wind during pressing. Further, the drive of the endless belt is very awkward and susceptible to disturbances. Additionally, a large amount of space is required to remove the refuse bale from the pressing device.

The problem forming the basis of the invention lies in providing a round bale press which saves space and also enables the packaging of refuse with a very high moisture content.

This technical problem is solved by a round bale press which is provided with a plurality of spaced rolls of which at least one is driven, at least one endless belt carried or supported by the rolls and a cylindrical pressing chamber formed by displacement of the rolls along a predetermined path and end walls arranged at the end faces of the rolls, the pressing chamber being provided with a peripheral feed opening. Additionally, a refuse packaging device is provided which comprises such a round bale press, a wrapping apparatus arranged downstream of the round bale press for wrapping the pressed refuse bale, wrapped around its generating shell surface in netting, in one or more foil webs, and a delivery station arranged beyond the wrapping apparatus for the refuse bales completely wrapped by the foil web.

The invention is based on the concept of forming a cylindrical or cylindrical section-shaped pressing chamber of a round bale press such that it is substantially sealed and simultaneously producing a space-saving mode of construction. On account of the design of an endless belt supported by means of individual rolls and end walls arranged at the end faces, for the first time, a pressing chamber has been provided which is closed in itself apart from the feed opening for the supplied refuse. As a result of the moveable design of the rolls and the endless belt wrapped around these, the delivery of a refuse bale wrapped in a cylindrical form has also been made possible in a space-saving manner. In the known state of the art, a considerable structural height was required in order to take the pressed refuse bales out of the press. By displacing the rolls along a predetermined path line, for the first time, the structural height can advantageously be reduced to the height preset by the dimensions of the pressing chamber.

Advantageously, the path line is made up by a circular arc section with a looping angle of 300° to 340° and an adjacently arranged path section. On account of the looping angle of 300° to 340°, the peripheral feed opening is predetermined in a simple manner. Due to the adjacently arranged path section, the pressing chamber of the round bale press can be opened for delivery of the pressed refuse bale without space being required above the pressing chamber.

The path section arranged adjacent to the circular arc section advantageously has at least such a length that the rolls arrangable in the circular arc section can be substantially accommodated. On account of this, it is ensured that the opening of the pressing chamber can be so wide that the refuse bale formed in the pressing chamber can be removed from the pressing chamber.

A very simple design of the path line is produced by two opposing connecting link guides arranged at the end faces of the rolls. In this manner, a technically very simple guiding of the rolls is achieved.

On account of the connecting link guides respectively consisting of rails open towards the end faces of the rolls, wherein the tapered axle sections of the rolls project into the rails, a very robust and cheap design has been provided with simple technical means.

The rolling support of the axle sections in the connecting link guide also enables a low friction and, thus an energy-saving displacement of the rolls in the connecting links.

Advantageously, the rolls are formed as cylindrical rolls which extend across essentially the entire width of the cylindrical pressing chamber. As a result of coupling parts arranged at their end faces, a constant upholding of the spacing of the rolls necessary for moving the rolls is ensured in a simple manner.

Advantageously, a fixed rotatable cylindrical roll is arranged in the area of the feed opening and the endless belt is guided around it. On account of this, the endless belt has a twin function. On the one hand, the rotation of the refuse in the pressing chamber is achieved and, on the other hand, a simple feed apparatus is simultaneously provided for feeding the refuse into the feed opening.

In order to be able to maintain the endless belt at a predetermined tension during the displacement of the cylindrical rolls as well as during the pressing process, two cylindrical rolls are advantageously arranged opposite each other and the endless passes therebetween. In this case, it is advantageous that the cylindrical rolls are rotatable about a common axis so that the tension of the endless belt between the cylindrical rolls is adjustable according to rotation of the cylindrical rolls about the common axis.

A very advantageous embodiment is provided in that above the feed opening, there are at least two spaced cylindrical rolls about which a further endless belt is guided. This ensures an optimal guiding of the refuse to the feed opening.

As a result of the fact that at least one of these cylindrical rolls is drivable, a proper transport of the refuse into the pressing chamber is additionally made possible.

Advantageously, the height of the feed opening can be adjusted by adjusting the endless belt arranged above the feed opening.

A very simple adjustment of the feed opening is advantageously provided in that the roll which lies closest to the pressing chamber is pivotable.

A very advantageous embodiment includes a netting web feeding device in the area of the feed opening in order to be able to wrap the netting web around the periphery of the refuse bales. In this manner, a refuse bale of stable form can be produced which can be further transported in an even better manner and without loss of refuse from the pressed refuse bales.

If the netting web feeding device consists of a net roll and two netting web supply rolls through which the netting web can be introduced, a very simple and cheap supply of netting web into the pressing chamber is provided.

On account of the design of at least one of the netting web supply rolls as a driven roll, the transport of the netting web into the pressing chamber takes place in a more advantageous manner.

In order to be able to fix the refuse bales in a stable form with the netting web, the netting web must be wound around the refuse bales under a specific tension. The tension is provided by electrically braking the drive motor after introducing the net. If the netting web lies against the refuse bale and rotates together with this in the pressing chamber and the drive motor on the netting web roll is retarded in the direction opposite the direction of movement of the netting web in an infinitely adjustable manner, the tension can be regulated in an continuously variable manner. As a result of the tension, a drawing-in of the netting web in the width direction ensues so that the side edges of the pressed refuse bale cannot be covered with the netting web. In order to provide a wrapping of the netting web which reaches close to the end faces of the refuse bale, it is very advantageous to design the netting web supply rolls to be adjustable along their rotational axes. In this manner, the netting web clamped between the netting web supply rolls can also be supplied under tension up to the side edges.

In case that the netting web rolls can be reciprocated in an oscillating manner, each side edge can be completely covered by the netting web when wrapping the refuse bale in the web.

It is particularly advantageous if a detector device is arranged in the area of the feed opening and that it recognizes the type and/or quantity of the supplied refuse and issues a corresponding signal to the control device for the rotational speed of the rolls. In this manner, it is possible to optimally adapt the rotational speed, i.e. the rotation of the refuse in the pressing chamber, in dependence on the type of refuse. Additionally, when no refuse is supplied for a certain time, the rotation can be stopped, which produces a saving of energy.

An advantageous embodiment of the detector device comprises a laser device. This guarantees a contactless and disturbance-free scanning of the refuse.

Figure 2:
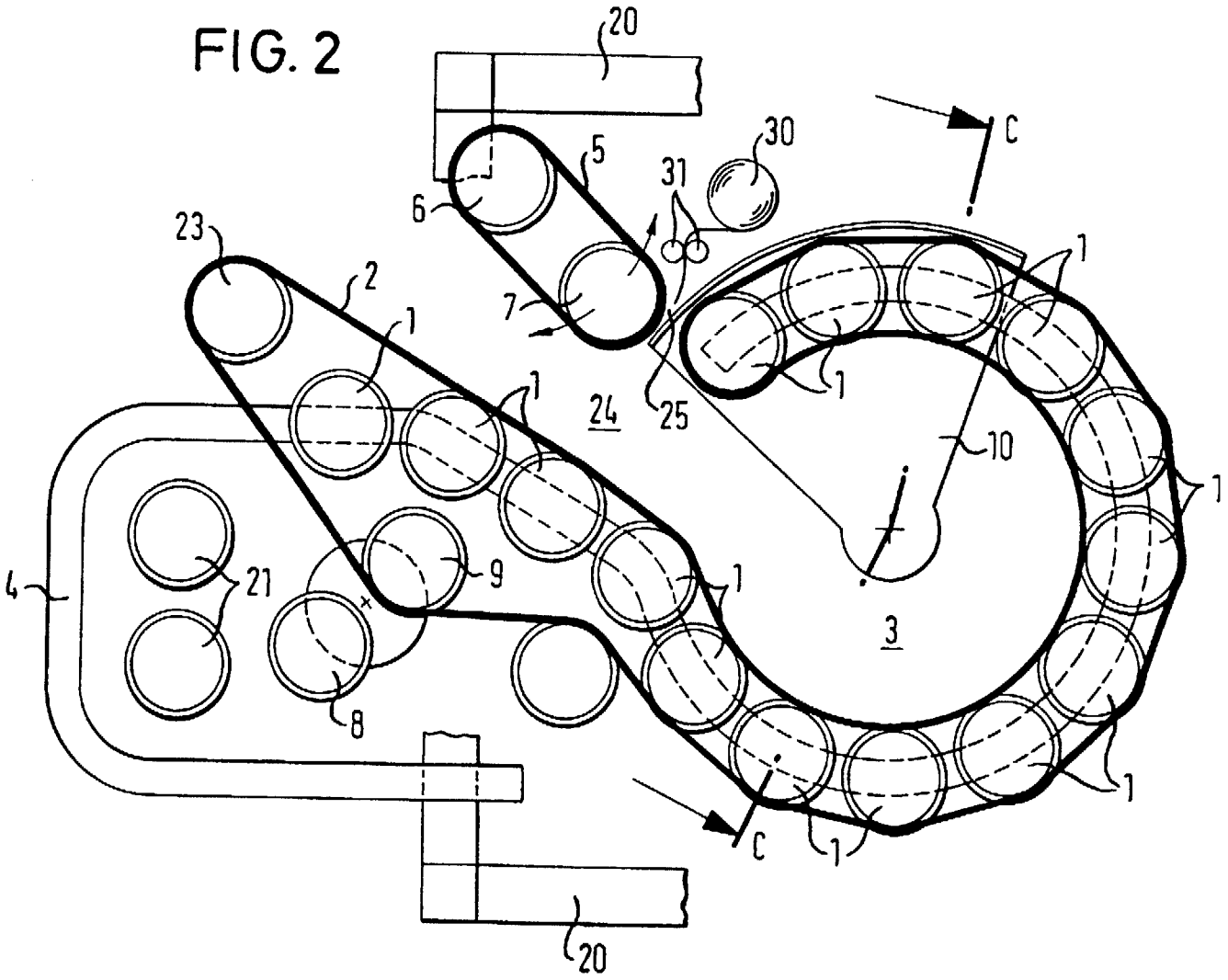
Figure 3:
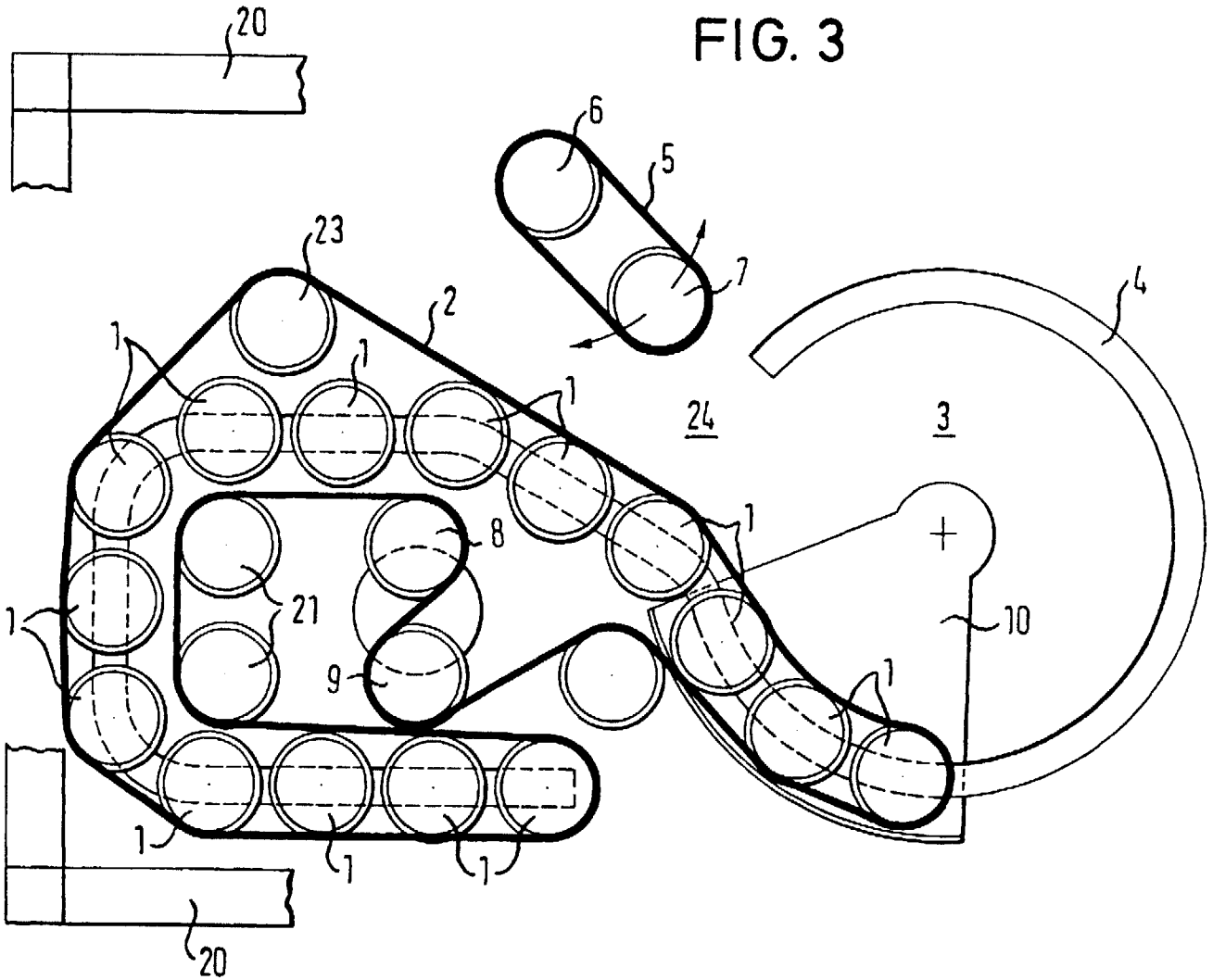
Figure 4:
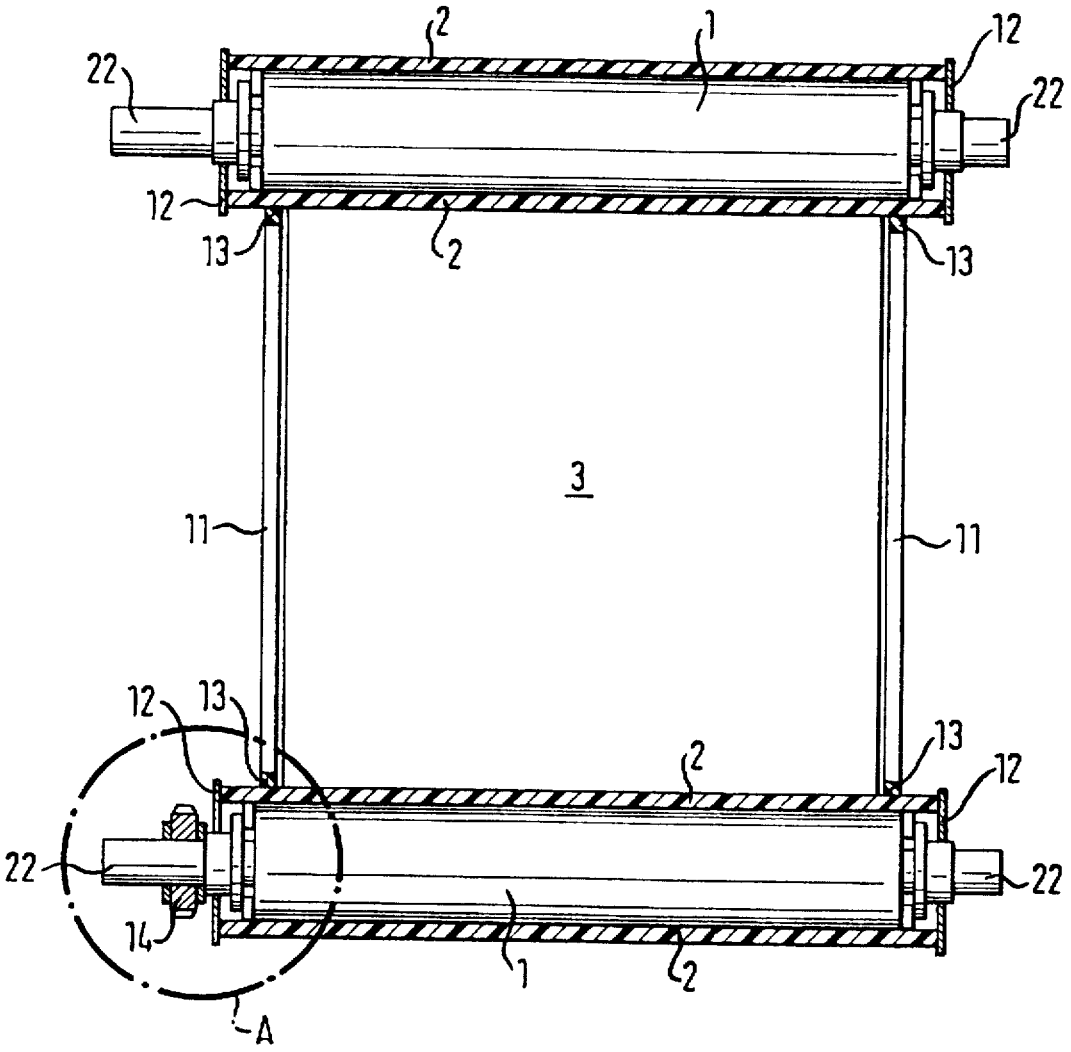
Figure 5:
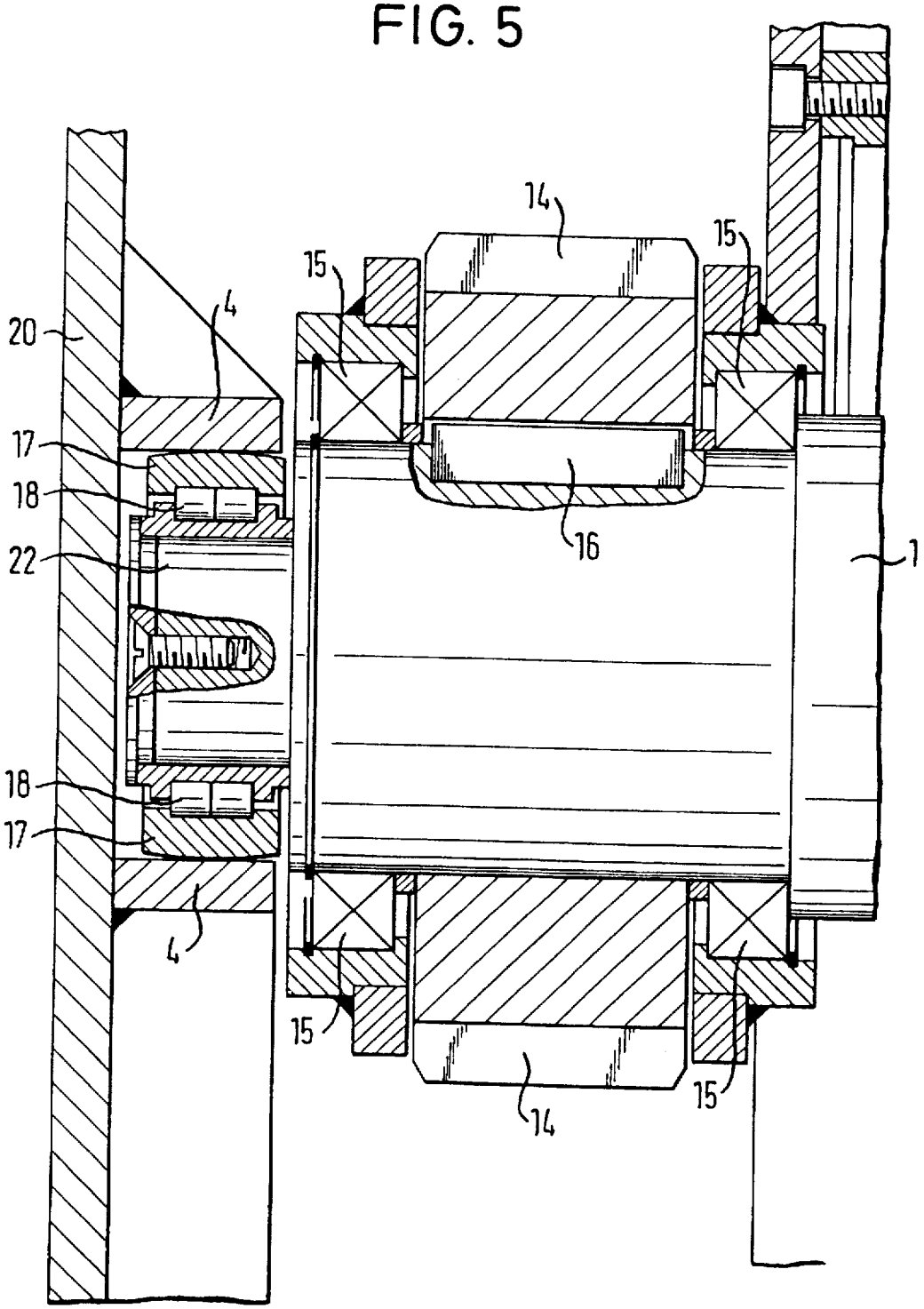
Figure 6:
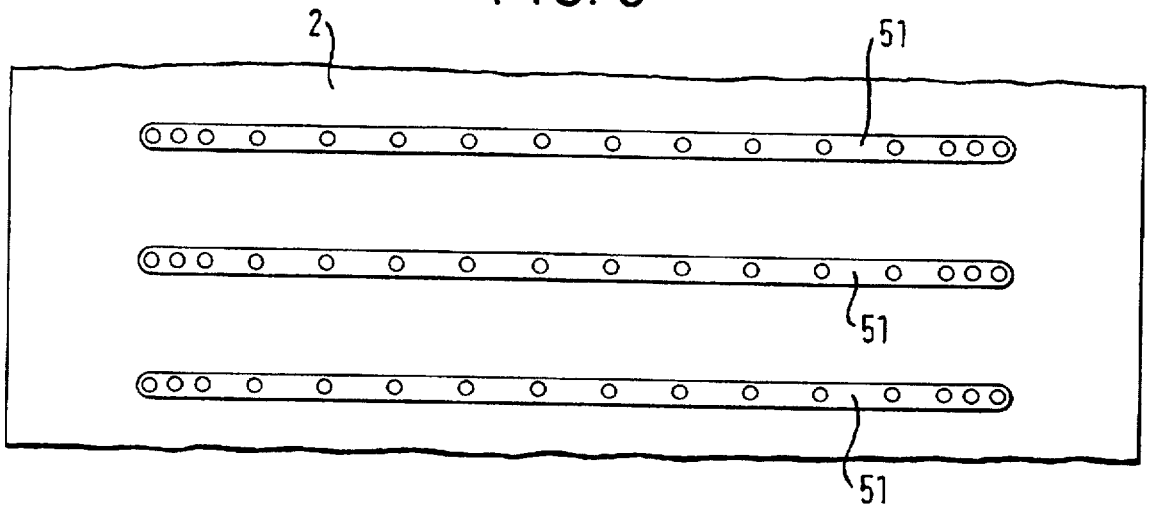
Figure 7:
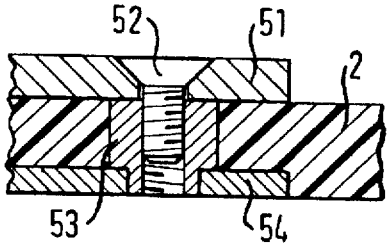
Figure 8:
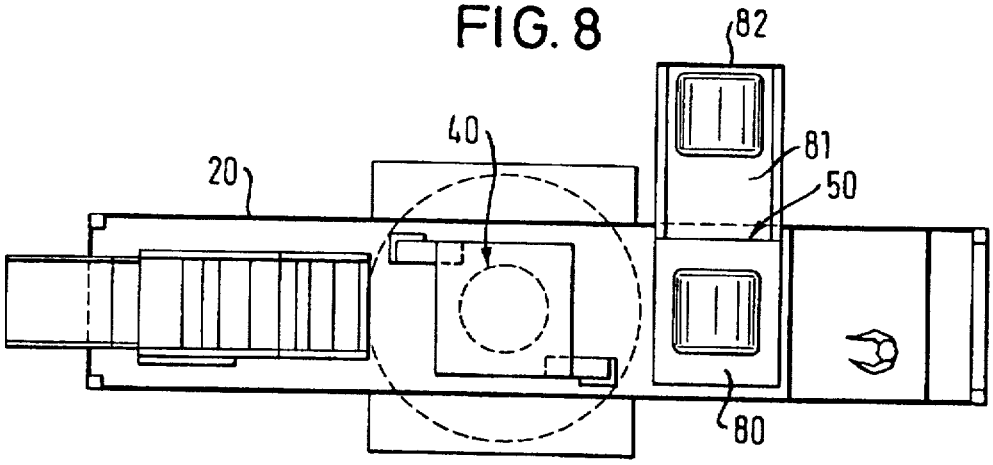

For explanation and better understanding, an exemplary embodiment of the invention is described and explained in more detail in the following with reference to the enclosed drawings, in which:

FIG. 1 shows a schematic longitudinal sectional view through a refuse packaging device according to the invention, FIG. 2 shows a schematic cross-sectional view through an inventive round bale press in the operating condition;

FIG. 3 shows a schematic cross-sectional view through an inventive round bale press in the opened position, FIG. 4 shows a cross-sectional view along the line C—C in FIG. 2, FIG. 5 shows a detail "A" of an axle section of a cylindrical roll as shown in FIG. 4, FIG. 6 shows a plan view of an endless belt used in the round bale press, FIG. 7 shows a cross-sectional view through an endless belt according to FIG. 6, and FIG. 8 shows a schematic plan view of a refuse packaging device according to FIG. 1.

A schematic longitudinal cross-sectional view through a refuse packaging device is shown in FIG. 1 in which the individual components are housed in a mobile container 20. At the inlet of the container 20, there is a round bale press which is described later in more detail. A wrapping apparatus 40 is arranged in series after the round bale press. In this wrapping apparatus 40, the refuse bale pressed in the round bale press and wrapped around its periphery with a netting web is completely wrapped in a foil web 41. Beyond the wrapping apparatus 40, there is a delivery station 50 which delivers the refuse bales completely wrapped up in one or more, in this case two foil webs, into or out of the direction extending into or out of the drawing plane.

The round bale press used in this refuse packaging device is now described in more detail with reference to FIGS. 2 to 5.

As shown in FIG. 2, the round bale press has a number of rotatable, driven cylindrical rolls 1. The cylindrical rolls 1 are arranged in the operating position shown in FIG. 2 in such a manner on a radius at a distance from each other that a cylindrical or cylindrical section-shaped pressing chamber 3 is formed having a feed opening arranged in the upper half of the pressing chamber 3. The cylindrical rolls 1 are arranged along a connecting link guide 4. In the forward area of the feed opening 24, there is a stationary guide roil 23. Beneath the connecting link guide 4, there are two rotatably supported tensioning rolls 8, 9. An endless belt 2 is guided about the cylindrical rolls 1, the guide rolls 23 and the tensioning roll 9.

In the operating condition shown in FIG. 2, the cylindrical pressing chamber 3 is formed by the cylindrical rolls 1, the endless belt 2 and opposing end walls as shown in FIG. 4. In this case, the feed opening 24 is formed on the periphery in the upper half in the cross section. Two further cylindrical rolls 6, 7 are arranged above the feed opening 24 and an endless belt 5 is guided around these. One of these cylindrical rolls 6, 7 is driven. The cylindrical roll 7 lying closer to the pressing chamber 3 can be pivoted about the rotational axis of the opposing associated cylindrical roll 6. A gap 25 remains between the pivotable cylindrical roll 7 and the closest cylindrical roll 1 as seen in the operating position. Above this gap 25, there is a netting web feeding device which consists of a netting web roll 30 and two netting web supply rolls 31 arranged beneath this.

The connecting link guide 4 is formed by different sections in the view illustrated in FIGS. 2 and 3. A first section is formed in that it describes an essentially circular radius. This is followed by a slightly upwardly inclined, straight section. Proceeding from this straight section, the connecting link guide 4 extends downwardly in an essentially U-shaped form. In this U formed by the connecting link guide 4, there are two further fixed, rotatable cylindrical rolls 21 and the tension rolls 8, 9. A further fixed, rotatable cylindrical roll is arranged beside the tension rolls 8, 9.

The cylindrical rolls 1 which are arranged to be displaceable along the connecting link guide 4 are maintained at a distance from each other by spacers. The first three cylindrical rolls 1 are respectively held at the end faces by rotary segments 10. The rotary segments 10 can be rotated about a horizontal rotational axis which corresponds to the axis of symmetry of the pressing chamber 3.

The round bale press is shown in the open state in FIG. 3. In this, the cylindrical rolls 1 are moved along the connecting link guide 4 so that the pressing chamber 3 is open at the peripheral side towards the wrapping apparatus 40. The endless belt 2 is held under tension by the tension rolls 8, 9 and the cylindrical rolls 21. In order to maintain the endless belt 2 under tension during displacement of the cylindrical rolls along the connecting link guide 4, the tension rolls 8, 9 are continuously rotatable in a corresponding manner about a horizontal rotational axis which lies in the middle of the two tension rolls 8, 9.

A sectional view along the line C—C in FIG. 2 is shown in FIG. 4. It can be seen in this that the cylindrical rolls 1 have tapered axle sections 22 which, as shown in the detail in FIG. 5, project into the respective connecting link guides 4 at the end faces. In the sectional view shown in FIG. 4, a toothed wheel 14 for driving the cylindrical roll 1 is mounted on an axle section 22. The endless belt 2 extends across the width of the cylindrical rolls 1. There are guide disks 12 mounted at the end faces on the cylindrical rolls 1 which prevent the endless belt 2 from running off the cylindrical wall 1. The end face walls 11 which are sealed by sliding seals 13 with respect to the endless belts 2 are arranged between the opposite cylindrical rolls 1 and the endless belt 2 lying on these. The pressing chamber 3 is therefore formed by the end face walls 11 and the endless belt 2. The mounting of a toothed wheel 14 on the tapered axle section 22 of a cylindrical roll 1 and the guidance in the connecting link guide 4 can be seen in the detailed view "A" of FIG. 4 illustrated in FIG. 5. The toothed wheel 14 is secured on the axle section 22 in a torsionally stiff manner by means of a key 16. A sealing to the outside is provided by means of seals 15. The connecting link guide 4 is formed by opposing rails in which a roll body 11 is fitted in a rollable manner with a clearance fit. The tapered axle section 22 of a cylindrical roll 1 is held in this by a roller bearing 18 located therein in a rotatable manner and is displaceable along the connecting link guide 4.

An advantageous exemplary embodiment of an endless belt used in the round bale press is illustrated in FIGS. 6 and 7. It can be easily seen in the plan view of an endless belt shown in FIG. 6 that mounted on the rubber belt forming the endless belt 2 on the inner side of the endless belt 2 are parallel spring steel strips 51 which do not extend across the entire width of the rubber belt. The spring steel strips 51 project approximately 3 to 10 mm above the rubber belt. This ensures a reliable transport of the supplied refuse.

As can be seen in FIG. 7, the spring steel strips 51 are secured onto the rubber belt 2 by a number of countersunk screws 52. The countersunk screws 52 are respectively screwed into welded on sleeves 53 extending through the rubber belt 2. The welding on sleeves 53 are themselves pressure-welded to a steel strip 54 inlayed or countersunk into the lower side of the rubber belt. As a result of this fastening of the spring steel strips 51, a very good highly mechanically loadable connection with the rubber belt is provided. A ripping out of the spring steel strips 51 can therefore be avoided in an optimal manner. The fastening of the spring steel strips 51 can advantageously also ensue by means of rivets.

A chain belt consisting of individual chain elements movably arranged in series can also be suitable for use in the round bale press of the type described above. Thus, such a chain belt consists of individual members which substantially extend between the opposing end face walls 11 and are respectively provided with integral elevations. These elevations fulfil the function of the spring steel strips 51 of the previously described rubber belt. For example, such chain elements can be produced from an aluminium alloy or from another metal. As seen in plan view, the individual chain elements can have bulges and recesses into which respectively adjacent recesses and bulges of another chain element engage. The chain elements are connected to each other by means of connecting rods. In this case, the tolerances between the individual chain elements are selected to be so narrow that substantially no trickling material can escape out of the pressing chamber 3.

The operation of a refuse packaging device comprising the above components is now described. The cylindrical rolls 1 are moved by the rotary segment 10 out of their position illustrated in FIG. 3 into the operating position illustrated in FIG. 2. As a result of the rotation of the opposing rotary segments 10, the cylindrical rolls 1 coupled to each other are moved far enough into the circular arc section of the connecting link guide 4 that the cylindrical pressing chamber 3 is formed with the peripheral feed opening 24. In this case, the tension of the endless belt 2 surrounding the cylindrical rolls 1 is maintained at the necessary level by rotation of the tension rolls 8, 9. As shown in FIG. 2, the feed opening 24 is formed, for example, by the second endless belt 5 together with and the straight section of the endless belt 2. By feeding onto the endless belt 2 in the area of the straight section, the refuse is guided into the feed opening 24. In this case, the endless belt 2 rotates in a counter-clockwise direction. The rotation of the endless belt 2 is effected by driving the cylindrical rolls 1 via the toothed wheels 14. Simultaneously, the endless belt 5 arranged above the feed opening is driven by one of the cylindrical rolls 6, 7 in the same direction as the endless belt 2.

In this manner, the refuse is introduced through the feed opening 24 into the pressing chamber 3. During the supply of the refuse into the pressing chamber 3, the refuse is continuously turned within the pressing chamber 3. The supply of the refuse takes place until the pressing chamber 3 is completely filled and a refuse bale of the predetermined thickness has produced by rotation.

Subsequently, a netting web is fed into the pressing chamber 3 by the netting web roll 30 via the netting web guide rolls 31. Simultaneously, the endless belt 2 continues to run. Thus, within the pressing chamber 3, the rolled-up refuse bale is wrapped around its periphery in the netting web. In order to produce a netting web wrap which reaches to the outer edges of the refuse bale, the netting web rolls 31 oscillate to and fro along their rotational axis. Once the refuse bale is completely wrapped in a netting web within the pressing chamber 3, the drive of the cylindrical rolls 1 is stopped. The rotary segment 10 is then turned in the clockwise direction. In this manner, the cylindrical rolls 1 are displaced along the connecting link guide 4 together with the endless belt 2. The rotary segment 10 is rotated until the refuse bale in the pressing chamber 3 can fall onto a wrapping table 42 moved in during the process of movement of the cylindrical rolls 1. Once the refuse bale wrapped on its peripheral side lies on the wrapping table 42, this is moved together with the refuse bale to the wrapping apparatus 40.

After this, the refuse bale rotatably supported on the wrapping table 42 is wrapped in that the refuse bale is rotated about its cylindrical axis and, simultaneously, two spaced foil holding apparatus arranged outside the area of the refuse bale are rotated about the refuse bale. In this manner, the refuse bale is completely wrapped around its end faces and around its periphery in an extendable foil web 41. During the wrapping process, a new refuse bale can be produced in the round bale press.

Following wrapping of the refuse bale in the foil 41, the wrapping table 42 is moved to the delivery station 50 and from there via a tilting mechanism onto a moving table. The completely wrapped refuse bale is then discharged from this moving table to a side of the container 20. The transport of the refuse bale out of the container 20 can then ensue in a standing or lying position.

During the supply of the refuse into the pressing chamber 3 in the round bale press, a detection of the supplied refuse advantageously takes place to the extent that the type, composition and quantity of the supplied refuse is detected. According to requirements, the feed opening 24 can then be narrowed or widened by rotating the cylindrical roll 7. In the event that the pressing chamber 3 is not completely filled and no new refuse is supplied to it for a time, then the rotation of the endless belt 2 is stopped. Only when the detector device again registers supplied refuse is the endless belt 2 started via the cylindrical rolls 1.

The removal of a refuse bale in the lying position is illustrated by way of example in FIG. 8. Due to the fact that the refuse bales are transferred from the wrapping table 42 to the delivery station 50 on a trough-shaped belt 80 extending perpendicularly to the direction of movement of the wrapping table, the refuse bale is transferred in the lying position to the right or to the left by movement of the trough-shaped belt 80. Adjoined to the troughed belt 80 is a further trough-shaped belt 81 which is rotatable with respect to a horizontal rotational axis. If a lying removal is desired, then the refuse bale is transferred from the troughed belt 80 to the troughed belt 81. The refuse bale can then be transported away from this location. If a standing removal is desired, then the troughed belt 81 with the refuse bale thereon is rotated about a horizontal rotational axis, on account of which the refuse bale comes to lie on one of its end faces. For this purpose, an end wall 82 extending perpendicular to the trough belt 81 is arranged at the end of the troughed belt. The refuse bale is then placed on this end wall.

We claim:

1. A round bale press for refuse, comprising:

a pair of endwalls, a plurality of spaced rolls between the endwalls and having end faces adjacent to the respective endwalls, at least one of the spaced rolls being driveable, at least one endless belt supported by the spaced rolls, and means for slidably supporting the spaced rolls for forward movement in a curved path to define a cylindrical pressing chamber with a feed opening on the periphery, the pressing chamber being capable of forming round bales, and for reverse movement of the rolls in the curved path to deliver the formed bales from the cylindrical pressing chamber.

2. A round bale press according to claim 1, wherein the curved path includes a circular arc section with a looping angle of 300° to 340° and an adjacent path section.

3. A round bale press according to claim 2, wherein the adjacent path section has a length to substantially accommodate the rolls capable of being arranged in the circular arc section.

4. A round bale press according to claim 1, wherein the curved path is formed by two opposing connecting link guides arranged at the end faces of the rolls.

5. A round bale press according to claim 4, wherein the connecting link guides respectively comprise U-shaped rails open towards the end faces of the rolls, the rolls having tapered axle sections projecting into the rails.

6. A round bale press according to claim 5, wherein the axle sections are rotatably supported in the connecting link guides.

7. A round bale press according to claim 1, wherein the rolls are cylindrical rolls and including coupling members at the end faces to keep the rolls at a constant distance from each other.

8. A round bale press according to claim 1, wherein the endless belt is guided about a fixed cylindrical roll arranged in the area of the feed opening.

9. A round bale press according to claim 1, wherein the endless belt is straight in the region of the feed opening.

10. A round bale press according to claim 1, including two tension rolls, between which the endless belt extends, arranged opposite each other in the adjacent path section, the two tension rolls being revolvable about a common axis.

11. A round bale press according to claim 1, including at least two spaced cylindrical rolls above the feed opening and a further endless belt guided about the two spaced cylindrical rolls.

12. A round bale press according to claim 11, wherein at least one of the cylindrical rolls can be driven.

13. A round bale press according to one of the claims 11 or 12, wherein the feed opening is adjustable by means of the further endless belt.

14. A round bale press according to one of the claims 11 or 12, wherein one of the cylindrical rolls lies closest to the pressing chamber and is pivotable.

15. A round bale press according to claim 1, wherein the endless belt comprises a rubber belt.

16. A round bale press according to claim 1, wherein the endless belt comprises a chain belt formed by chain elements hingedly connected to each other.

17. A round bale press according to claim 1, wherein a netting web feeding device is arranged in the area of the feed opening.

18. A round bale press according to claim 17, wherein the netting web feeding device includes a netting roll and two netting web feed rolls between which a netting web can be introduced.

19. A round bale press according to claim 18, wherein at least one of the netting web feed rolls can be driven.

20. A round bale press according to claim 18, wherein the netting web feed rolls are displaceable along their rotational axes.

21. A round bale press according to claim 18 wherein the netting web feed rolls clamp the netting web introduced therebetween.

22. A round bale press according to claim 18, wherein the netting web rolls are movable to and fro in an oscillating manner.

23. A round bale press according to claim 1, including a detecting device in the region of the feed opening for recognizing the type and/or quantity of the refuse to be fed and for issuing a corresponding signal to a control device for the rotational speed of the rolls.

24. A round bale press according to claim 23, wherein the detecting device comprises a laser device.

25. A refuse packaging device, comprising:

a round bale press having a pair of endwalls, a plurality of spaced rolls between the endwalls, at least one of the spaced rolls being driveable, at least one endless belt supported by the spaced rolls, and means for slidably supporting the spaced rolls for forward movement in a curved path to define a cylindrical pressing chamber with a feed opening on the periphery, the pressing chamber being capable of forming round bales, and for reverse movement of the rolls in the curved path to deliver the formed bales from the cylindrical pressing chamber, a wrapping apparatus arranged downstream of the round bale press for wrapping the formed round bales, wrapped peripherally in a netting web, in one or more foil webs, and a delivery station arranged beyond the wrapping apparatus for the refuse bales wrapped up completely with the foil web.

26. A refuse packaging device according to claim 25, wherein for transport of the refuse bale from the round bale press to the wrapping apparatus and for transport from the wrapping apparatus to the delivery station, a moveable wrapping table is provided and equipped with at least one driven endless belt upon which the refuse bale lies, the moveable wrapping table being rotatable about its axis of symmetry.

27. A refuse packaging device according to claim 25 or 26, wherein the delivery station comprises at least one trough-shaped endless belt by which a refuse bale can be transported away.

28. A refuse packaging device according to claim 27, wherein one of the trough-shaped belts is rotatable.

* * * * *